US009477174B1

(12) United States Patent
Hill et al.

(10) Patent No.: US 9,477,174 B1
(45) Date of Patent: Oct. 25, 2016

(54) USING ACCUMULATED PIXEL COUNTING TO ASSESS SOLID AREA DENSITY PERFORMANCE TO ENABLE AUTOMATIC DENSITY CORRECTION AND IMPROVE TONER YIELD

(71) Applicant: Xerox Corporation, Norwalk, CT (US)

(72) Inventors: Alun Henry Hill, Hertfordshire (GB); Timothy David Jonathan Spink, Hertfordshire (GB)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/046,016

(22) Filed: Feb. 17, 2016

(51) Int. Cl.
*G03G 15/08* (2006.01)

(52) U.S. Cl.
CPC ..... *G03G 15/0831* (2013.01); *G03G 15/0848* (2013.01)

(58) Field of Classification Search
CPC ..... G03G 15/0831; G03G 15/0848
USPC ..... 399/27–30
See application file for complete search history.

(56) References Cited

U.S. PATENT DOCUMENTS 6,810,218 B1 * 10/2004 Wong ..... G03G 15/0849 399/27
7,302,198 B2 * 11/2007 Ahn ..... G03G 15/556 399/27
7,983,575 B1 7/2011 Zona et al.

* cited by examiner

*Primary Examiner* — Hoang Ngo
(74) *Attorney, Agent, or Firm* — Fay Sharpe LLP

(57) ABSTRACT

This disclosure provides a method and system to adjust pixel density based on a weight and an accumulated pixel count of a printer cartridge. According to an exemplary method, the weight and the accumulated pixel count of the printer cartridge are calculated to determine a pixel density of the printer cartridge, and then a toner output of an associated printing device is adjusted if the pixel density is outside of a predefined pixel density threshold.

20 Claims, 2 Drawing Sheets

USING ACCUMULATED PIXEL COUNTING TO ASSESS SOLID AREA DENSITY PERFORMANCE TO ENABLE AUTOMATIC DENSITY CORRECTION AND IMPROVE TONER YIELD

CROSS REFERENCE TO RELATED PATENTS AND APPLICATIONS

U.S. patent application Ser. No. 10/662,252, filed Sep. 15, 2003 (since issued as U.S. Pat. No. 6,810,218) and U.S. patent application Ser. No. 12/647,908, filed Dec. 28, 2009 (since issued as U.S. Pat. No. 7,983,575) are incorporated herein by reference in their entirety.

BACKGROUND

With typical printers, and in particular xerographic printers, the regulation of density of the image printed on the media is very important as this controls image intensity (i.e., how light or how dark an image is) and also affects toner runs cost. Dark images use more toner and, thus, cost more to run.

To measure the image density requires additional sensors with an increased machine cost and can also affect productivity. However, these sensors can be expensive. As a result, to save cost, most printers do not have sensors to monitor the current image density and automatically adjust and correct the solid area density which governs the light/dark appearance of the image. A low solid area density image appears very light. A high solid area density will appear dark. A very high solid area density will still appear dark but will just be using more toner needlessly.

Without manual intervention, a printer can continue printing images that are either too dark or too light. This can lead to user complaints about images being too light to see or images being too dark such that image highlights are lost. In addition, images that are too dark cost more to run as toner is being used unnecessarily, thereby impacting the toner yield of the cartridge.

The present disclosure presents systems and methods to measure image density without needing an additional sensor or affecting productivity.

BRIEF DESCRIPTION

In one embodiment of this disclosure, described is a computer-implemented method of controlling a toner output for a printing device. The method includes: determining, with a weight module, a weight value of toner in a printer cartridge that is installed in an associated printing device; determining, with a counting module, an accumulated pixel count value of the printer cartridge when the printer cartridge is empty; calculating, with a calculating module, a print density value for the printer cartridge from the weight value and the accumulated pixel count value of the printer cartridge; and adjusting, with an adjusting module, a toner output of the associated printing device when the print density value of the printer cartridge is outside of a predefined pixel density threshold value.

In another embodiment of this disclosure, described is a system for controlling a toner output for a printing device. The system includes a weight module programmed to determine a weight value of toner in a printer cartridge that is installed in an associated printing device. A counting module is programmed to determine an accumulated pixel count value of the printer cartridge when the printer cartridge is empty. A calculating module is programmed to calculate a print density value for the printer cartridge from the weight value and the accumulated pixel count value of the printer cartridge. An adjusting module is programmed to adjust a toner output of the associated printing device when the print density value of the printer cartridge is outside of a predefined pixel density threshold value.

In still another embodiment of this disclosure, described is a system for controlling a toner output for a printing device. The system includes a weight module programmed to determine a weight value of toner in a printer cartridge that is installed in an associated printing device. A counting module is programmed to determine an accumulated pixel count value of the printer cartridge when the printer cartridge is empty. A calculating module is programmed to calculate a print density value for the printer cartridge from the weight value and the accumulated pixel count value of the printer cartridge. An adjusting module is programmed to: reduce the toner output of the associated printing device when the print density value of the printer cartridge is less a predefined pixel density threshold value of approximately 25 L*; and increase the toner output of the associated printing device when the print density value of the printer cartridge is greater than the predefined pixel density threshold value of approximately 25 L*. A retrieving module is programmed to: retrieve excess expelled toner from the printer cartridge; and store the excess expelled toner in the associated printing device.

DETAILED DESCRIPTION

Figure 1:
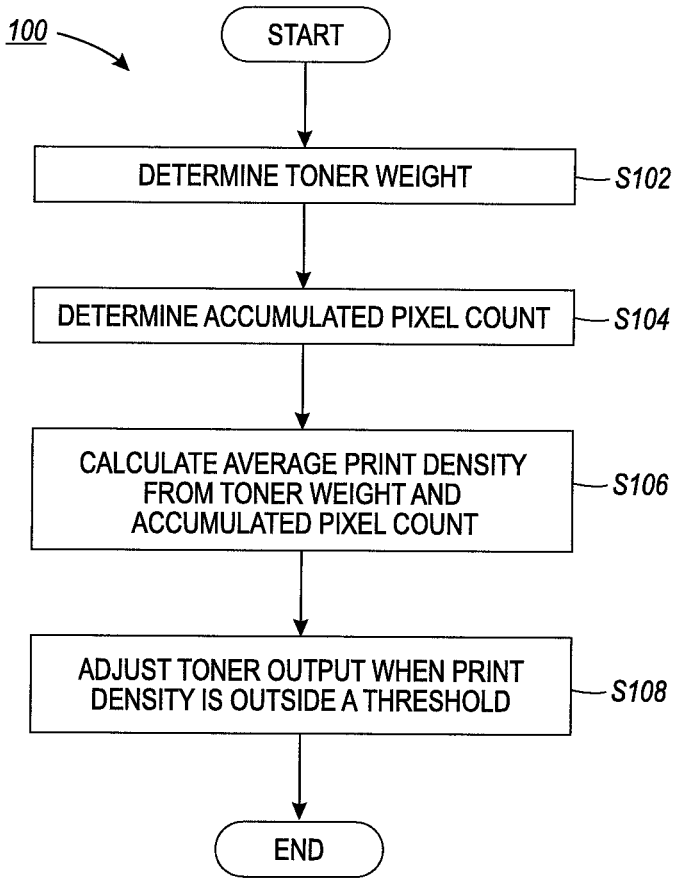
FIG. 1 is a flow chart of a method to adjust pixel density according to an exemplary embodiment of this disclosure.

As used herein, the term "printer cartridge" (and variants thereof) refers to a device that holds ink or toner and is configured to be installed in a printing device.

As used herein, the term "printing device" (and variants thereof) refers to a device (e.g., a printer, a copier, a scanner, and the like) that outputs images on a paper using ink or toner from a printer cartridge.

As used herein, the term "out of toner event" (and variants thereof) refers to an event in which the printer cartridge does not contain any more toner (i.e., the printer cartridge is empty).

As used herein, the term "toner output" (and variants thereof) refers to an output of toner from a printer cartridge per unit area on a piece of paper.

This disclosure provides a method and system for using an accumulated pixel count from a printer cartridge, along with a toner fill weight to estimate a density (i.e., mass per unit area) of ink being developed. Advantageously, this improves density control without requiring a density sensor. The disclosed systems and methods improve image quality for users whose markers are running too light, and also improve printer cartridge life for users whose markers are running too dark.

Advantageously, the disclosed methods and systems calculate the image density without needing additional sensors and thus achieve a better toner yield and reduce run costs. Every image that is sent to the print engine has an associated pixel image count. These pixels have a fixed density. Each new toner bottle has a fixed mass and capable of delivering "X" number of pixels at a certain fixed density. Every time a printer cartridge is consumed a calibration can be made to adjust the image density up or down.

The disclosed methods and systems also adjust the average image density to maintain optimum level, thereby advantageously increasing customer satisfaction and reducing run cost without incurring any additional cost for hardware.

It will be appreciated that the disclosed methods and systems can be implemented into any associated printer, regardless of the type of ink used or the image path used (e.g., printing, copying, Eco-printing, standard, and the like). Advantageously, the disclosed methods and systems work with ink jet printers, xerograph printers and solid ink printers, color printers, mono toner printers, and the like.

According to an exemplary embodiment, image density is measured using an "L*" scale (pronounced L star) where a larger value of L* is associated with a relatively lighter image, or, in other words a lower image density. In one example, a good solid dark image gives approximately a 25 L* reading. In one example, correcting the solid Area Density from 24 L* to 25 L*, thereby decreasing the image density, will increase the copies per toner cartridge life by over 1400 prints based on 6% area coverage on 8.5"×11" paper. For example, with an average printer cartridge yield of 25,000 prints per printer cartridge, a 1400 sheet increase results in an 18% increase. If each printer cartridge costs $40, then that's a saving of $7.

If a printer is producing images darker than the nominal 25 L* reading, or developing toner in non-image areas i.e., a background of an image, then the actual accumulated pixel count will be lower than the optimum value for a given fill weight. In other words, the printer is using relatively more toner to create images and therefore fewer images per toner cartridge can be printed. If the printer is producing images lighter than the nominal<25L* reading, then the accumulated pixel count will be greater than the optimum value.

According to exemplary embodiments described herein, each printer cartridge will have a specific accumulated pixel count that it is capable of producing. The value of the accumulated pixel count associated with a toner cartridge at the end of its useful life is mainly a function of the following: (1) the printer cartridge fill weight; and (2) the average density of the images produced. Moreover, there is a good correlation between the toner used and the printer cartridge fill weight.

If a printer cartridge fill weight is known the only other variable that affects the accumulated total pixel count achievable by the cartridge is the average density of the images printed during the life of the printer cartridge. Therefore there is an optimum value for the accumulated pixel count for an associated toner cartridge for the toner's fill weight associated with the toner cartridge. Test data can be used to calculate the optimum accumulated pixel count for the toner fill weight and develop equations that correlates the accumulated pixel count and the toner fill weight to calculate an average L* over the life of the printer toner cartridge.

The present disclosure and exemplary embodiments described herein provide a comparison of the actual accumulated pixel count for the printer toner cartridge to an optimum accumulated pixel count associated with the printer toner cartridge. At the end of every printer toner cartridge life, adjustments can be made to modify the average solid area density associated with the performance of the printer.

Notably, an accumulated pixel count does not always account for all toner usage. There is often residual toner in the toner cartridge when it's replaced. In addition, many markers also produce waste toner. An ink-jet printer product may have purge cycles which use ink, while a xerographic marker may develop background toner, or develop control patches on the photoreceptor in order to monitor voltages.

To address these issues, the system and method of the present disclosure take these effects into account by gathering statistics on the amount of residual toner left in a printer toner cartridge at replacement. For example, waste toner is dealt with for ink-jet printers by adding pixels to the accumulated pixel count for each purge cycle. Also, for xerographic printers which have toner reclaim systems, the reclaim systems decrease the amount of uncounted waste toner by putting background and control patch toner back into the cartridge, where the disclosed system and method modify the accumulated pixel count accordingly.

With reference to FIG. 1, shown is a flow chart of a method 100 to control toner output according to an exemplary embodiment of this disclosure. The method 100 includes: determining a weight of toner in a printer cartridge that is installed in the associated printing device S102; determining an accumulated pixel count of the printer cartridge when the printer cartridge is empty S104; calculating an average print density for the printer cartridge from the weight and the accumulated pixel count of the printer cartridge S106; and adjusting a toner output of the associated printing device when the print density of the printer cartridge is outside of a predefined pixel density threshold S108.

At S102, a weight of toner in a printer cartridge that is installed in the associated printing device is determined. To do so, the weight of a full printer cartridge is determined when the printer cartridge is installed in the printing device. In other words, the weight of the cartridge itself is determined to find the weight of the toner. This weight value can be recorded and stored in a memory of the printing device. When an out of toner event occurs, such as the printer cartridge being empty (i.e., out of toner), the value of the weight of the empty printer cartridge (i.e., the weight of the printer cartridge itself) is determined, recorded, and stored in the memory. In one example, the weight of typical printer cartridges at an out of toner event is reasonably constant with a standard deviation of approximately 6.4 grams. The value of the empty printer cartridge is subtracted from the value of the full printer cartridge to determine the weight of the toner itself. Advantageously, the weight of the toner itself can be used to estimate how much toner was used over the life of the printer cartridge.

At S104, an accumulated pixel count of the printer cartridge is determined when the printer cartridge is empty. To do so, a pixel counting value of "zero" is set when the full printer cartridge is installed in the associated printing device. As the printer cartridge is used, the number of pixels is continuously counted while toner is expelled from the printer cartridge (i.e., during printing, scanning, and/or copying images). For example, the number of pixels that make up every image printed is calculated until the printer cartridge is empty, and updates the pixel counting number accordingly. When the printer cartridge is empty, the pixels are no longer counted. For example, the pixel count values for all images are added together to determine an accumulated pixel count value of the number of pixels used when the printer cartridge is empty. It will be appreciated that, at an out of toner event, the pixel counting value is at a maximum value. An example of how the accumulated pixel count is determined is described in more detail below.

In some exemplary embodiments, the pixel counting value is automatically reset to "zero," when the associated printing device recognizes that a new (i.e. full) printer cartridge is installed therein. For example, when the maximum pixel counting value is reached, the printer cartridge is empty. The pixel counting value is reset to "zero" when a new printer cartridge is installed in the associated printing device. The toner weight is stored in a memory of the print cartridge before the new printer cartridge is installed. When the associated printing device determines that an out of toner event has occurred, the printing device can read the toner weight from the memory of the printer cartridge, At S106, an average print density for the printer cartridge is calculated from the weight and the accumulated pixel count of the printer cartridge. To do so, the toner weight value (determined at S102) and the accumulated pixel count (determined at S104) can be input into an equation to determine the average print density. For example, a linear regression equation can be calculated (e.g., by using multiple sets of data including toner weight values and accumulated pixel counts of a plurality of printer cartridges, and the like), and the present values of the toner weight and accumulated pixels are input into the equation to output a printer density value. Once calculated, the printer density value has units of L*.

At S108, a toner output of the associated printing device is adjusted when the print density of the printer cartridge is outside of a predefined pixel density threshold. In one example, a predefined pixel density threshold value can be set. Specifically, the predefined threshold value can be set at approximately 25 L*. In this example, a threshold value of 25 L* is indicative of a good (i.e., not too dark or too light) toner output. The printer density value (determined at 106) is compared to the predefined threshold value (i.e. 25 L*) to determine if the toner output of the printing device needs to be adjusted. In some examples, when the printer density value is substantially equal to approximately 25 L*, the toner output is not changed. In other examples, when the print density of the printer cartridge is less than approximately 25 L*, the toner output of the printing device is reduced. In other words, the printing cartridge uses less toner during printing or copying. In further examples, when the print density of the printer cartridge is greater than approximately 25 L*, the toner output of the printing device is increased. In other words, the printing cartridge uses more toner during printing or copying.

Figure 2:
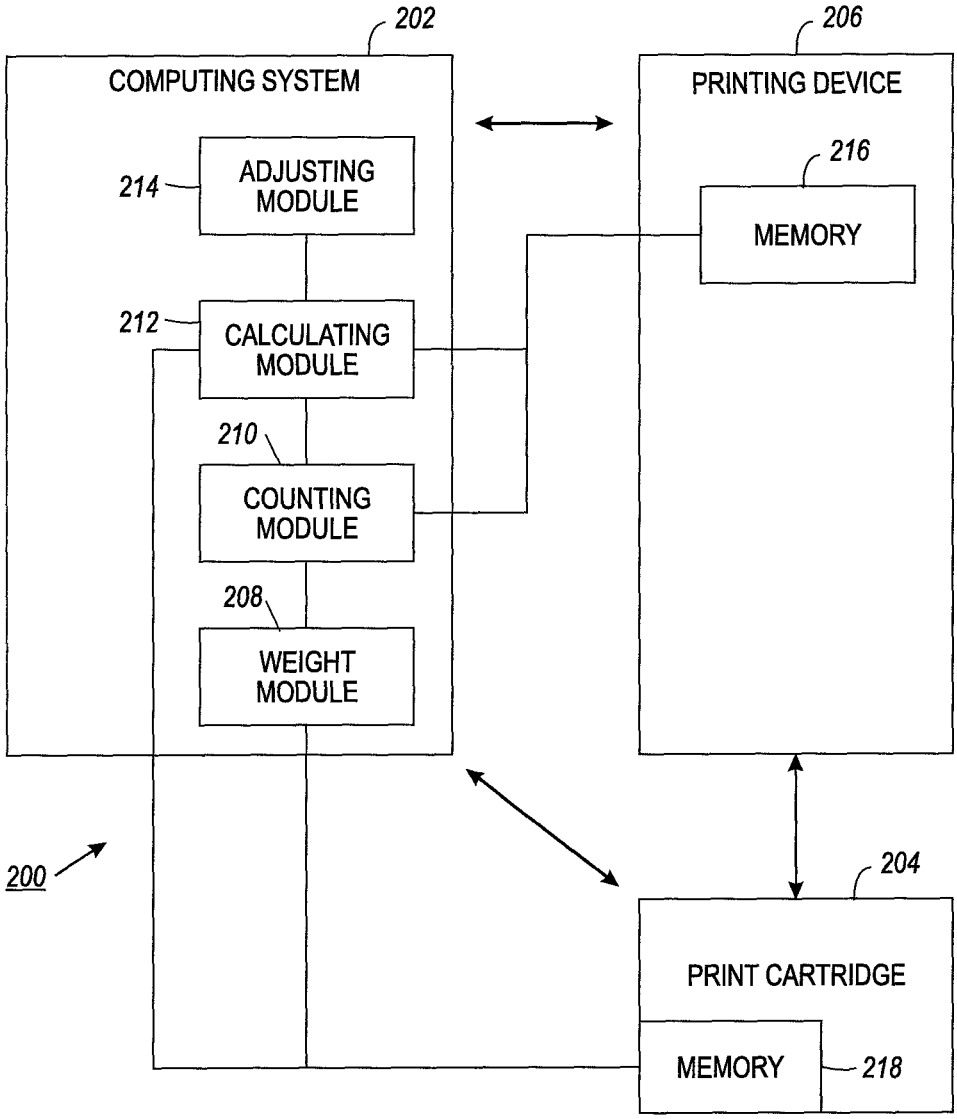
FIG. 2 is a block diagram of a system to adjust pixel density according to an exemplary embodiment of this disclosure.

With reference to FIG. 2, shown is a block diagram of a system 200 to implement the method 100 to control toner output according to an exemplary embodiment of this disclosure.

The system 200 can include a computer system 202 that is in communication with a printer cartridge 204 and a printing device 206. In some embodiments, the computer system 202 can be operably connected to the printer cartridge 204, and in communication with the associated printing device 206. In other embodiments, the computer system 202 can be operably connected to the printing device 206, and in communication with the associated printer cartridge 204. As described herein, the computer system 202 is operably connected to the printing device 206, and in communication with the associated printer cartridge 204. In some embodiments, the computer system 202 can include a weight module 208, a counting module 210, a calculating module 212, and an adjusting module 214. Each of these components 208-214 are described in more detail below.

The weight module 208 is programmed to determine a weight value of toner in a printer cartridge that is installed in an associated printing device. To do so, the weight module 208 is programmed to record a value of the weight of the full printer cartridge 204 when the printer cartridge is installed in the printing device 206. For example the full weight value can be stored in a memory 216 of the printing device 206 or in a memory 218 of the printer cartridge 204. In addition, the weight module 208 is also programmed to record a value of the weight of the printer cartridge 204 when the printer cartridge is empty. The empty weight value can also be stored in the memory of the printing device 206. It will be appreciated that the weight of typical printer cartridges at an out of toner event is reasonably constant with a standard deviation of approximately 6.4 grams. When the empty weight value is stored, the weight module 208 is programmed to subtract the value of the weight of the printer cartridge 204 when the printer cartridge is empty from the value of the weight of the full printer cartridge when the printer cartridge is installed in the associated printing device. Thus, the weight of the toner itself is determined. The toner weight value can also be stored in the memory 216 of the printing device 206.

The counting module 210 is programmed to determine an accumulated pixel count value of the printer cartridge when the printer cartridge is empty. To do so, the counting module 210 is programmed to set a pixel counting value of "zero" when the full printer cartridge 204 is installed in the printing device 206. While toner is expelled from the printer cartridge 204 (e.g., during printing, copying, and the like), the counting module 210 is programmed to continuously count the number of pixels used until the printer cartridge is empty. For example, the counting module 210 is programmed to add together the pixel count values for all images, and add this number to the pixel counting value to determine an accumulated pixel count value of the number of pixels used when the printer cartridge 204 is empty. It will be appreciated that, at an out of toner event, the pixel counting value is at a maximum value.

The counting module 210 is also programmed to automatically reset the pixel counting value to "zero." For example, when the printer cartridge 204 is empty, the accumulated pixel counting value has reached a maximum value, and the pixel counting value is reset to "zero" when a new, full printer cartridge 204 is installed in the printing device 206. The accumulated pixel count value can also be stored in the memory 216 of the printing device 206. The toner weight is stored in the memory 218 of the printer cartridge 204 before the new printer cartridge is installed. When the printing device 206 determines that an out of toner event has occurred, the printing device can read the toner weight from the memory 218 of the printer cartridge 204, The calculating module 212 is programmed to calculate a print density value for the printer cartridge 204 from the weight value and the accumulated pixel count value of the printer cartridge. For example, the calculating module 210 is programmed to retrieve the weight value determined by the weight module 208 and the accumulated pixel count value determined by the counting module 210 from the memory 216 of the printer 206. These values can be input into an equation (e.g., a linear regression algorithm, an exponential equation, a logarithmic equation, and the like). The equation can be determined from using multiple sets of data including toner weight values and accumulated pixel counts of a plurality of printer cartridges, and the like). When the present values of the weight and accumulated pixel count are input into the equation, the calculating module is then programmed to calculate a print density value (in units of L*) as an output of the equation. The calculated print density value can be stored in the memory 216 of the printing device 206.

The adjusting module 214 is programmed to adjust a toner output of the printing device 206 when the print density value of the printer cartridge 204 is outside of a predefined pixel density threshold value. For example, a predefined pixel density threshold value can be set. Specifically, the predefined threshold value can be set at approximately 25 L*. It will be appreciated that a threshold value of 25 L* is indicative of a good toner output (i.e., the printed image is not too dark or too light). The adjusting module 214 is further programmed to retrieve the calculated print density value from the memory 216 of the printing device 206. The retrieved print density value is compared to the predefined threshold value. Based on this comparison, the adjusting module 214 is programmed to determine if the toner output of the printing device 206 needs to be adjusted. In some examples, when the printer density value is substantially equal to approximately 25 L*, the adjusting module 214 is programmed to not change the toner output. In other examples, when the print density of the printer cartridge 204 is less than approximately 25 L*, the adjusting module 214 is programmed to reduce the toner output of the printing device. In other words, the printing cartridge 204 uses less toner during printing or copying. In further examples, when the print density of the printer cartridge 204 is greater than approximately 25 L*, the adjusting module 214 is programmed to increase the toner output of the printing device. In other words, the printing cartridge 204 uses more toner during printing or copying.

It will be appreciated that the predefined pixel density threshold value can be user-configurable. For example a user can change the settings of the printing device 206 such that the predefined pixel density threshold value of approximately 25 L* (or any other desired value). In addition, comparison settings of the predefined pixel density threshold value can be user-configurable. For example, a user can change the settings of the printing device 206 to determine a range in which the calculated print density values are outside of a range of values of the predefined threshold. Specifically, for a predefined threshold value of 25 L*, a user can adjust the settings of the printing device 206 such that a calculated print density value of approximately 24.0 L* is below the predefined threshold value. Similarly, a user can adjust the settings of the printing device 206 such that a calculated print density value of approximately 26.0 L* is above the predefined threshold value.

In addition, the user can adjust the settings of the printing device to reduce the range of values that are considered "within" a predefined threshold value range. For example, for a predefined threshold value of 25 L*, a user can adjust the settings of the printing device such that a calculated print density value of approximately 24.5 L* is below the predefined threshold value, and a value of 25.5 L* is above the predefined threshold value (i.e. plus or minus 0.5 L*). It will be appreciated that these ranges are used to determine if the calculated print density value is outside (e.g., exceeds or under runs) the predefined threshold value range.

Example 1

Determining Accumulated Pixel Count Value

An example of the disclosed system and method for determining the accumulated pixel count of a printer cartridge is described as follows. When a new printer cartridge 204 (i.e., full of toner) is installed in the printing device 206, the weight module 208 determines the weight of the full printer cartridge and stores this value in the memory 216 of the printing device. To do so, the toner mass is determined as the weight of the printer cartridge 204 when it is full of toner minus the weight of the printer cartridge when it is empty. For example, the weight value of the full printer cartridge 204 can be approximately 650.0 grams. The weight of an empty printer cartridge 204 can be approximately 150.0 grams. Therefore, the weight value of the toner loaded can be approximately 500.0 grams.

In addition, when the full printer cartridge 204 is installed in the printing device 206, the counting module 210 is programmed to set a pixel counting value of "zero".

It will be appreciated that a printer resolution value of the printing device 206 can be set at 1200 pixels per inch. As a result, the pixel count for a solid area of 1.0 $in^2$ is 1,440,000 pixels/$in^2$.

In addition, one or more settings of the printing device 206 can be adjusted so that an ideal toner mass (grams per square inch) can be developed on to the paper. In one example, the ideal toner mass can be approximately 0.003 g/$in^2$. Moreover, it can be assumed that there is a relationship between toner mass transferred from the printing cartridge 204 to a paper (not shown) and the solid area density of the toner. The transferred toner mass is the mass of the toner that is transferred to the paper. In addition, the solid area of the paper is determined to be a solid area (i.e., a 100% area coverage, not a halftone area). As a result, when the transferred toner mass is correct, the solid area density will also be correct.

It can be shown that when the Accumulated Pixel Count recorded by the printing device 206 (when an out of toner event is declared), is equal to the Ideal Accumulated Pixel Count, the average density of the prints will be correct.

The Ideal Accumulated Pixel Count for printer cartridge is a function of the weight of toner used (i.e., 500 grams), the ideal solid area mass of the toner per unit area (i.e., 0.003 g/$in^2$), and the resolution of the printing device 206 (i.e., 1,440,000 pixels/$in^2$). The Ideal Accumulated Pixel Count for the toner cartridge 204 must be determined. The Ideal Accumulated Pixel Count of the toner cartridge 204 can be determined from Equation 1:

$$IAPC=PC*TM/ITD \quad \text{(Equation 1)}$$

where IAPC is the Ideal Accumulated Pixel Count, PC is the pixel count for a solid area of 1.0 square inches, TW is the weight of the toner in used, and ITD is the Ideal solid area density of the toner. Using the values given above (i.e., PC=1,440,000 pixels/$in^2$, and TW=500.0 g) for the solid area density of the toner (i.e., TD=0.003 g/$in^2$), it can be determined that $$IAPC=(1{,}440{,}000 \text{ pixels}/in^2)*(500.0 \text{ g})/0.003 \text{ g}/in^2$$

$$IAPC=2.4\times10^{11} \text{ pixels}$$

The Accumulated Pixel Count is recorded by the printing device 206 at an out of toner event. For any printer cartridge the toner used is and the pixels/$in^2$ are fixed values and therefore changes in Accumulated Pixel Count are proportional to solid area density of the toner (ATD). If the print density is correct the Accumulated Pixel Count will equal the IAPC $$APC=PC*TM/ATD \quad \text{(Equation 2)}$$

where ATD is the Actual solid area density of the toner.

In one example, the printing device 206 can be printing images that are too light. In this case the actual solid area density of the toner is too low. For example, if the ATD of the printing cartridge 204 is determined to be 0.002 g/in$^2$, then the APC can be calculated using Equation 2.

$$APC=(1{,}440{,}000\ \text{pixels/in}^2)*(500.0\ \text{g})/(0.002\ \text{g/in}^2)$$

$$APC=3.6\times10^{11}\ \text{pixels}$$

As a result, the adjusting module 214 can increase the actual solid area density of the toner, thus producing darker images.

In another example, the printing device 206 can be printing images that are too dark. In this case the actual solid area density of the toner is too high. For example, if the ATD of the printing cartridge 204 is determined to be 0.004 g/in$^2$, then the APC can be calculated using Equation 2.

$$APC=(1{,}440{,}000\ \text{pixels/in}^2)*(500.0\ \text{g})/(0.004\ \text{g/in}^2)$$

$$APC=1.8\times10^{11}\ \text{pixels}$$

As a result, the adjusting module 214 can decrease the actual solid area density of the toner, thus producing lighter images.

It will be appreciated that the toner mass per unit area is the factor that changes solid area density. For example, if ATD=0.002 g/in$^2$, the average L* value would be higher than the ideal L* value (i.e., producing lighter images). By using Equation 2, a higher accumulated pixel count can be obtained. In another example, if ATD=0.004 g/in$^2$, the average L* value would be lower than the ideal L* value (i.e., producing darker images). By using Equation 2, a lower accumulated pixel count can be obtained.

It will also be appreciated that the obtained L* value, in some examples, may be slightly different from the ideal L* value due to unaccountable losses. Therefore the Ideal Accumulated Pixel Count and average L* values can also be obtained from experimentation by monitoring the accumulated pixel count and Average L* values from the test prints made during the development stage of the printing device 206. For example, the unaccountable losses may be due to the transfer efficiency of the printing device 206, purge cycles, or toner development in an inter document gap.

Example 2

Determining Print Density L* Value

An example of the disclosed system and method for determining the print density L* value is described as follows. When a new printer cartridge 204 (i.e., full of toner) is installed in the printing device 206, the weight module 208 determines the weight of the full printer cartridge and stores this value in the memory 216 of the printing device. For example, the weight value of the full printer cartridge 204 can be approximately 700.0 grams. This value can be stored in the memory 218 of the printer cartridge 204.

In addition, when the full printer cartridge 204 is installed in the printing device 206, the counting module 210 is programmed to set a pixel counting value of "zero". As the printer cartridge 204 is used (i.e., expels toner), the counting module 210 continuously counts the number of pixels and adds this number to the pixel counting value (i.e., so that the pixel counting value is continuously updated).

When the printer cartridge 204 is empty, the weight module 208 determines the weight of the empty printer cartridge. For example, the weight value of the empty printer cartridge can be approximately 80.5 grams. The weight module 208 then subtracts the empty printer cartridge weight value from the full printer cartridge weight value to determine the weight of the toner. For example, the weight module can subtract 80.5 (i.e., the empty printer cartridge weight value) from 700.0 (i.e., the full printer cartridge weight value) to achieve a toner weight value of approximately 619.5. The toner weight value can then be stored in the memory 216 of the printing device 206.

In addition, when the printer cartridge 204 is empty, the counting module 210 stops counting the number of pixels. Thus, the pixel counting value at the time the printer cartridge 204 runs out of toner is the accumulated pixel count value. For example, after a full printer cartridge 204 is used, the accumulated pixel count value can be determined to be 2,343,083 pixels. The accumulated pixel count value can be stored in the memory 216 of the printing device 206.

When the toner weight value and the accumulated pixel count value are stored in the memories 216 and 218, the calculating module 212 is programmed to calculate the print area density value (i.e., L*). For example, a linear regression equation (or any other suitable type of equation) can be used to calculate the print area density value. The equation can be determined from many cycles of determining pixel area density values from multiple printer cartridges 204. In one example, the equation can be determined to be:

$$L^*=(1.026*10^{-3})*tw^2+-1.27*tw+(8.0*10^{-5})*apc+401.33 \quad \text{(Equation 3)}$$

where "tw" is the toner weight value and "apc" is the accumulated pixel count value. This equation is stored in the memory 216 of the printing device 206. Using the present values of the toner weight (619.5) and the accumulated pixel count (2,343,083) in Equation (3), the print density value can be solved for:

$$L^*=25.4 \quad \text{(Equation 4)}$$

Using Equation (4), the adjustment module 214 is programmed to determine if the toner output of the printing device 206 needs to be adjusted. This depends on the user-configurable range settings of the predefined threshold value (i.e., 25 L*). If the range settings are set such that a print density value of "plus or minus 0.5 L*" from the predefined threshold value (i.e. 24.5-25.5 L*), then the calculated print density value in equation 2 falls within this range, and the adjustment module 214 does not need to take action.

If however, the range settings are set such that a print density value of "plus or minus 0.2 L*" (i.e. 24.8-25.2 L*) from the predefined threshold value, then the calculated print density value in equation 2 falls outside of this range, and the adjustment module 214 needs to adjust the toner output. In this example, the calculated print density value exceeds the predefined threshold value, so the adjustment module 214 needs to increase the toner output of the printing device 206. On the other hand, if the calculated print density value was determined to be 24.7 L*, then this value underruns the predefined threshold value. The adjustment module 214 will then need to decrease the toner output of the printing device 206.

Some portions of the detailed description herein are presented in terms of algorithms and symbolic representations of operations on data bits performed by conventional computer components, including a central processing unit (CPU), memory storage devices for the CPU, and connected display devices. These algorithmic descriptions and representations are the means used by those skilled in the data processing arts to most effectively convey the substance of their work to others skilled in the art. An algorithm is generally perceived as a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be understood, however, that all of these and similar terms are to be associated with the appropriate physical quantities and are merely convenient labels applied to these quantities. Unless specifically stated otherwise, as apparent from the discussion herein, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The exemplary embodiment also relates to an apparatus for performing the operations discussed herein. This apparatus may be specially constructed for the required purposes, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms and displays presented herein are not inherently related to any particular computer or other apparatus. Various general-purpose systems may be used with programs in accordance with the teachings herein, or it may prove convenient to construct more specialized apparatus to perform the methods described herein. The structure for a variety of these systems is apparent from the description above. In addition, the exemplary embodiment is not described with reference to any particular programming language. It will be appreciated that a variety of programming languages may be used to implement the teachings of the exemplary embodiment as described herein.

A machine-readable medium includes any mechanism for storing or transmitting information in a form readable by a machine (e.g., a computer). For instance, a machine-readable medium includes read only memory ("ROM"); random access memory ("RAM"); magnetic disk storage media; optical storage media; flash memory devices; and electrical, optical, acoustical or other form of propagated signals (e.g., carrier waves, infrared signals, digital signals, etc.), just to mention a few examples.

The methods illustrated throughout the specification, may be implemented in a computer program product that may be executed on a computer. The computer program product may comprise a non-transitory computer-readable recording medium on which a control program is recorded, such as a disk, hard drive, or the like. Common forms of non-transitory computer-readable media include, for example, floppy disks, flexible disks, hard disks, magnetic tape, or any other magnetic storage medium, CD-ROM, DVD, or any other optical medium, a RAM, a PROM, an EPROM, a FLASH-EPROM, or other memory chip or cartridge, or any other tangible medium from which a computer can read and use.

Alternatively, the method may be implemented in transitory media, such as a transmittable carrier wave in which the control program is embodied as a data signal using transmission media, such as acoustic or light waves, such as those generated during radio wave and infrared data communications, and the like.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A computer-implemented method of controlling a toner output for a printing device, the method comprising:

determining, with a weight module, a weight value of toner in a printer cartridge that is installed in an associated printing device;

determining, with a counting module, an accumulated pixel count value of the printer cartridge when the printer cartridge is empty;

calculating, with a calculating module, a print density value for the printer cartridge from the weight value and the accumulated pixel count value of the printer cartridge; and adjusting, with an adjusting module, a toner output of the associated printing device when the print density value of the printer cartridge is outside of a predefined pixel density threshold value.

2. The method of claim 1, wherein the predefined threshold value is approximately 25 L*.

3. The method of claim 2, further including:

reducing, with the adjusting module, the toner output of the associated printing device when the print density value of the printer cartridge is less than approximately 25 L*.

4. The method of claim 2, further including:

increasing, with the adjusting module, the toner output of the associated printing device when the print density value of the printer cartridge is greater than approximately 25 L*.

5. The method of claim 1, wherein determining, with a counting module, an accumulated pixel count value of the printer cartridge when the printer cartridge is empty further includes:

setting a pixel counting value of zero when the full printer cartridge is installed in the associated printing device;

continuously counting the number of pixels used while toner is expelled from the printer cartridge until the printer cartridge is empty; and determining an accumulated pixel count value of the number of pixels used when the printer cartridge is empty.

6. The method of claim 5, further including:

resetting the pixel counting value to zero when a new, full printer cartridge is installed in the associated printing device.

7. The method of claim 1, wherein determining, with a weight module, a weight value of toner in a printer cartridge that is installed in an associated printing device further includes:

recording a value of the weight of the full printer cartridge when the printer cartridge is installed in the associated printing device;

recording a value of the weight of the printer cartridge when the printer cartridge is empty; and subtracting the value of the weight of the printer cartridge when the printer cartridge is empty from the value of the weight of the full printer cartridge when the printer cartridge is installed in the associated printing device.

8. A computer program product comprising a non-transitory recording medium storing instruction for performing the method of claim 1, and a processor in communication with the memory that implements the instructions.

9. A system comprising memory storing instructions for performing the method of claim 1, and a processor in communication with the memory which implements the instructions.

10. A system for controlling a toner output for a printing device, the system comprising:

a weight module programmed to determine a weight value of toner in a printer cartridge that is installed in an associated printing device;

a counting module programmed to determine an accumulated pixel count value of the printer cartridge when the printer cartridge is empty;

a calculating module programmed to calculate a print density value for the printer cartridge from the weight value and the accumulated pixel count value of the printer cartridge; and an adjusting module programmed to adjust a toner output of the associated printing device when the print density value of the printer cartridge is outside of a predefined pixel density threshold value.

11. The system of claim 10, wherein the predefined threshold value is approximately 25 L*.

12. The system of claim 11, wherein the adjusting module is further programmed to:

reduce the toner output of the associated printing device when the print density value of the printer cartridge is less than approximately 25 L*.

13. The system of claim 11, wherein the adjusting module is further programmed to:

increase the toner output of the associated printing device when the print density value of the printer cartridge is greater than approximately 25 L*.

14. The system of claim 10, wherein the counting module is further programmed to:

set a pixel counting value of zero when the full printer cartridge is installed in the associated printing device;

continuously count the number of pixels used while toner is expelled from the printer cartridge until the printer cartridge is empty; and determine an accumulated pixel count value of the number of pixels used when the printer cartridge is empty.

15. The system of claim 14, wherein the counting module is further programmed to:

resetting the pixel counting value to zero when a new, full printer cartridge is installed in the associated printing device.

16. The system of claim 10, wherein the weight module is further programmed to:

record a value of the weight of the full printer cartridge when the printer cartridge is installed in the associated printing device;

record a value of the weight of the printer cartridge when the printer cartridge is empty; and subtract the value of the weight of the printer cartridge when the printer cartridge is empty from the value of the weight of the full printer cartridge when the printer cartridge is installed in the associated printing device.

17. A system for controlling a toner output for a printing device, the system comprising:

a weight module programmed to determine a weight value of toner in a printer cartridge that is installed in an associated printing device;

a counting module programmed to determine an accumulated pixel count value of the printer cartridge when the printer cartridge is empty;

a calculating module programmed to calculate a print density value for the printer cartridge from the weight value and the accumulated pixel count value of the printer cartridge; and an adjusting module programmed to:

reduce the toner output of the associated printing device when the print density value of the printer cartridge is less a predefined pixel density threshold value of approximately 25 L*; and increase the toner output of the associated printing device when the print density value of the printer cartridge is greater than the predefined pixel density threshold value of approximately 25 L*.

18. The system of claim 17, wherein the counting module is further programmed to:

set a pixel counting value of zero when the full printer cartridge is installed in the associated printing device;

continuously count the number of pixels used while toner is expelled from the printer cartridge until the printer cartridge is empty; and determine an accumulated pixel count value of the number of pixels used when the printer cartridge is empty.

19. The system of claim 18, wherein the counting module is further programmed to:

resetting the pixel counting value to zero when a new, full printer cartridge is installed in the associated printing device.

20. The system of claim 17, wherein the weight module is further programmed to:

record a value of the weight of the full printer cartridge when the printer cartridge is installed in the associated printing device;

record a value of the weight of the printer cartridge when the printer cartridge is empty; and subtract the value of the weight of the printer cartridge when the printer cartridge is empty from the value of the weight of the full printer cartridge when the printer cartridge is installed in the associated printing device.

* * * * *